US012729484B2

(12) United States Patent
Nagai et al.

(10) Patent No.: US 12,729,484 B2
(45) Date of Patent: Sep. 8, 2026

(54) SHEET SEPARATING APPARATUS AND SHEET MANUFACTURING APPARATUS

(71) Applicant: SEIKO EPSON CORPORATION, Tokyo (JP)

(72) Inventors: Yoshikazu Nagai, Matsumoto (JP); Tetsuya Tamura, Matsumoto (JP); Akira Hashimoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 170 days.

(21) Appl. No.: 18/645,470

(22) Filed: Apr. 25, 2024

(65) Prior Publication Data

US 2024/0360623 A1 Oct. 31, 2024

(30) Foreign Application Priority Data

Apr. 27, 2023 (JP) ..... 2023-073106

(51) Int. Cl.
*D21F 5/02* (2006.01)

(52) U.S. Cl.
CPC ..... *D21F 5/022* (2013.01)

(58) Field of Classification Search
CPC ..... D21F 5/022
USPC ..... 162/306
See application file for complete search history.

(56) References Cited

U.S. PATENT DOCUMENTS

2016/0229093 A1 8/2016 Gomi
2017/0277086 A1* 9/2017 Hayase ..... G03G 15/2017

FOREIGN PATENT DOCUMENTS

JP 2009-092987 A 4/2009
JP 2015-080853 A 4/2015
JP 2016-204821 A 12/2016
JP 2017-125292 A 7/2017

* cited by examiner

*Primary Examiner* — Jacob T Minskey
(74) *Attorney, Agent, or Firm* — Spencer Fane LLP

(57) ABSTRACT

Rollers that transport a sheet while heating the sheet, and a separating unit that includes a separating plate and a supporting portion are included. The separating plate has a leading end portion that comes into contact with a second roller of the rollers. The supporting portion supports the separating plate. The separating plate is provided with a slit that absorbs bending due to a thermal expansion difference between the separating plate and the supporting portion.

4 Claims, 11 Drawing Sheets

SHEET SEPARATING APPARATUS AND SHEET MANUFACTURING APPARATUS

The present application is based on, and claims priority from JP Application Serial Number 2023-073106, filed Apr. 27, 2023, the disclosure of which is hereby incorporated by reference herein in its entirety.

BACKGROUND

1. Technical Field

The present disclosure relates to a sheet separating apparatus and a sheet manufacturing apparatus.

2. Related Art

Japanese Patent No. 6311749 discloses a configuration of a sheet manufacturing apparatus that causes a web, that is, a sheet such as copy paper to pass between a pair of heating and pressing rollers so as to perform heating and pressing on the sheet that is transported.

JP-A-2009-92987 discloses a configuration of an image forming apparatus that pinches a sheet with a heating roller and a pressing roller around which a fixing belt is wound and rotates the rollers so as to transport the sheet downstream. A separating member for separating a sheet adhering to the fixing belt is disposed near the fixing belt.

However, in the configuration described in Japanese Patent No. 6311749, there is a problem in which when a sheet adheres to the heating and pressing rollers, the sheet cannot be separated since a member for separating the sheet is not disposed, and the sheet cannot be transported downstream. In addition, in the configuration described in JP-A-2009-92987, there is a problem in which although a separating member is disposed, a leading end of the separating member is bent due to thermal expansion when heat is applied to the separating member, and the sheet cannot be separated appropriately from the heating roller or the pressing roller.

SUMMARY

A sheet separating apparatus includes a pair of rollers that transports a sheet while heating the sheet, and a separating unit that includes a separating plate and a supporting portion. The separating plate has a leading end portion that comes into contact with one roller of the pair of rollers. The supporting portion supports the separating plate. The separating plate is provided with a slit that absorbs bending due to a thermal expansion difference between the separating plate and the supporting portion.

A sheet manufacturing apparatus includes a supply unit that supplies a raw material, a deposition unit that accumulates a part of the raw material and forms a sheet, a pressing unit that presses the sheet, and a cutting unit that cuts the sheet. The pressing unit includes a pair of rollers that transports the sheet while heating the sheet, and a separating unit that includes a separating plate and a supporting portion. The separating plate has a leading end portion that comes into contact with one roller of the pair of rollers. The supporting portion supports the separating plate. The separating plate is provided with a slit that absorbs bending due to a thermal expansion difference between the separating plate and the supporting portion.

DESCRIPTION OF EMBODIMENTS

Hereinafter, in each figure, description will be given assuming that three axes orthogonal to each other are an X axis, a Y axis, and a Z axis. In addition, a direction extending along the X axis is referred to as an X direction, a direction extending along the Y axis is referred to as a Y direction, and a direction extending along the Z axis is referred to as a Z direction, and an arrow pointing direction is referred to as a positive direction, and an opposite direction of the positive direction is referred to as a negative direction. Note that a +Z direction may be referred to as up, upward, or a front side, and a −Z direction may be referred to as down, downward, or a rear side, and viewing in the +Z direction or the −Z direction is also referred to as plan view or in plan view. In addition, description will be given assuming that a surface on a positive side in the Z direction is an upper surface or a front surface, and a surface on a negative side in the Z direction, which is the opposite side of the surface on the positive side in the Z direction, is a lower surface or a rear surface.

First, with reference to FIG. 1, a configuration of a sheet manufacturing apparatus 1000 will be described.

Figure 1:
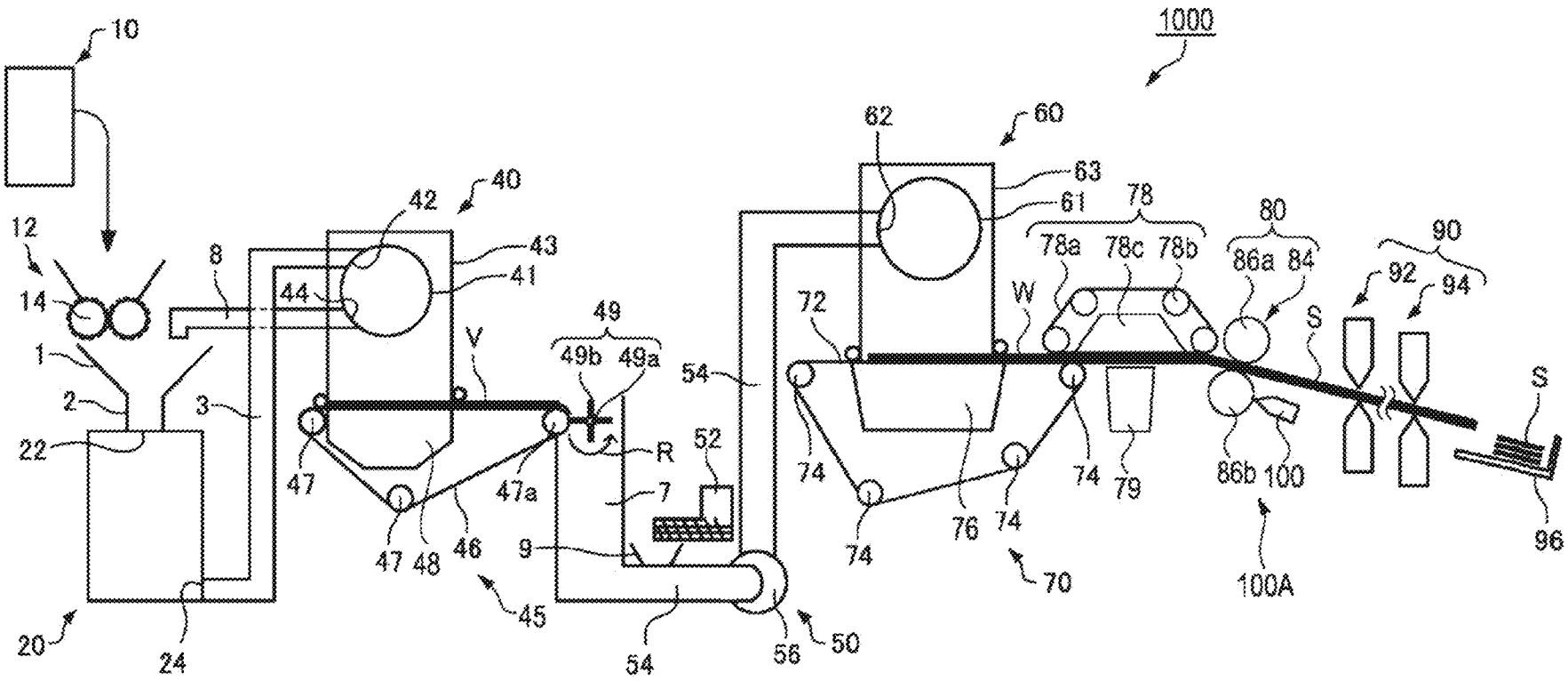
FIG. 1 is a schematic view illustrating a configuration of a sheet manufacturing apparatus.
Figure 2:
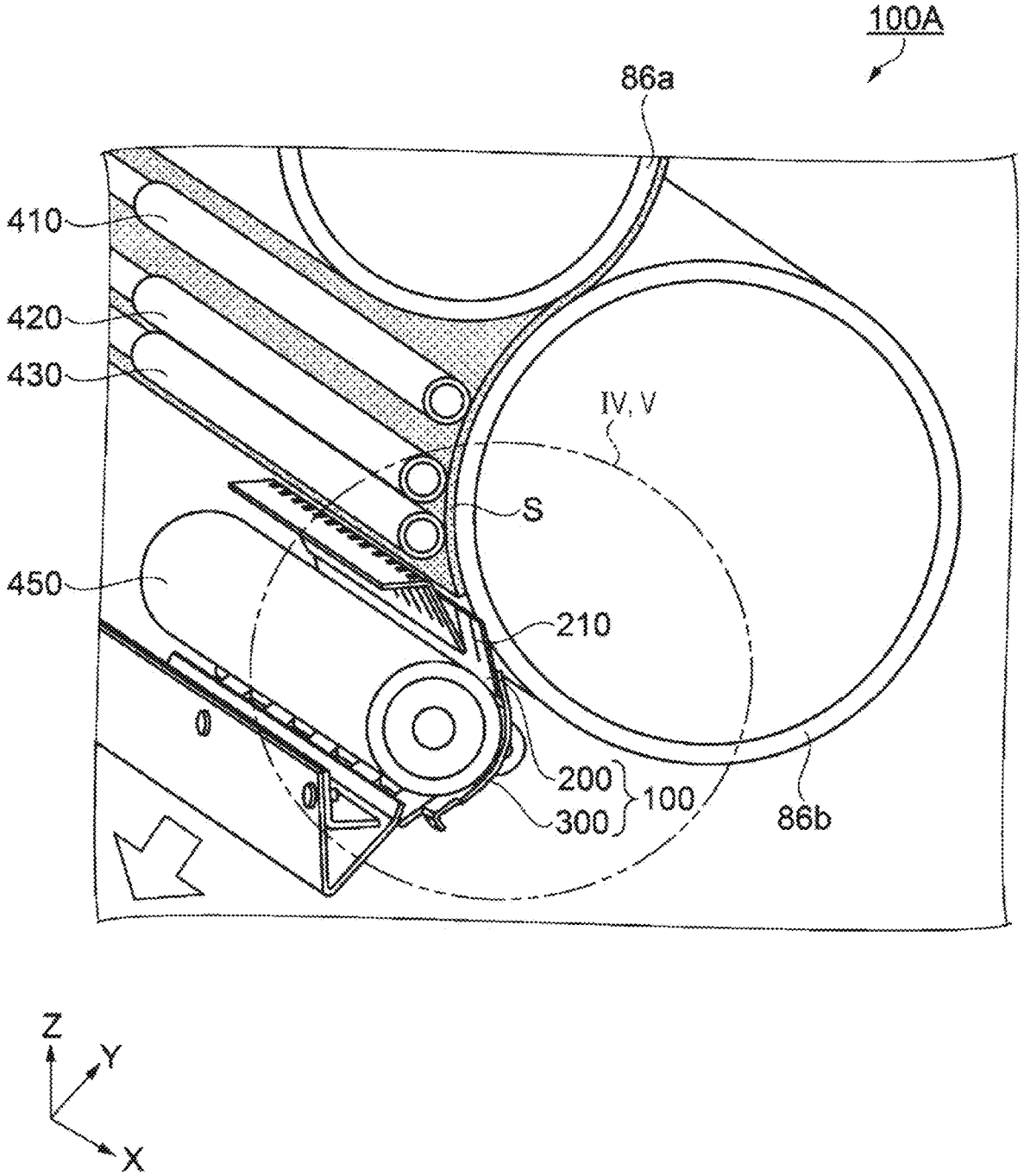
FIG. 2 is a perspective view illustrating a configuration of a sheet separating apparatus.

As illustrated in FIG. 1, the sheet manufacturing apparatus 1000 is, for example, an apparatus suitable for manufacturing new paper by using a dry defibration method to defibrate, into fibers, old used paper such as confidential paper as a raw material and then, performing pressing, heating and cutting. Through mixing of various additives to the raw material that has been defibrated into fibers, the binding strength or brightness of paper products may be improved, or functions such as color, scent, and flame retardance may be added, depending on the application. In addition, when paper is formed by controlling the density, the thickness, and the shape, the paper having various thicknesses and sizes such as A4 or A3 office paper and business card paper can thus be manufactured depending on the application.

The sheet manufacturing apparatus 1000 includes a supply unit 10, a crushing unit 12, a defibrating unit 20, a screening unit 40, a first web forming unit 45, a rotary body 49, a mixing unit 50, a deposition unit 60, a second web forming unit 70, a transport unit 78, a moisture applying unit 79, a pressing unit 80, and a cutting unit 90.

The supply unit 10 supplies a raw material to the crushing unit 12. The supply unit 10 is, for example, an automatic feeding unit for continuously feeding the raw material to the crushing unit 12. The raw material supplied by the supply unit 10 is a material containing various types of fibers.

The fibers are not particularly limited, and a wide range of fiber materials can be used. Examples of the fibers include natural fibers (animal fibers and plant fibers), and chemical fibers (organic fibers, inorganic fibers, and organic-inorganic composite fibers). More specifically, examples include fibers made from cellulose, silk, wool, cotton, hemp, ambary hemp, flax, ramie, jute, Manila hemp, sisal hemp, conifer, and broadleaf tree, and these fibers may be used independently, used by being appropriately mixed, or used as recycled fibers that have been refined.

Examples of the raw material of the fibers include pulp, used paper, and used cloth. In addition, various surface treatments may be performed on the fibers. In addition, the material of the fibers may be a pure material, or may be a material containing a plurality of components such as impurities and other components. In addition, a defibrated material obtained through defibration of used paper or a pulp sheet by using a dry method may be used as the fibers.

The crushing unit 12 cuts the raw material supplied by the supply unit 10 into small pieces in air such as in the atmosphere. The shape or the size of the small pieces is, for example, several centimeters square. In the example of FIG. 1, the crushing unit 12 includes a crushing blade 14, and the fed raw material can be cut by the crushing blade 14. As the crushing unit 12, for example, a shredder is used. The raw material cut by the crushing unit 12 is received by a hopper 1 and then transferred to the defibrating unit 20 through a pipe 2.

The defibrating unit 20 defibrates the raw material cut by the crushing unit 12. Here, the term "defibrate" refers to untangling, into individual fibers, the raw material in which a plurality of fibers is bonded. The defibrating unit 20 also has a function of separating, from the fibers, substances such as resin particles, ink, toner, or a blur preventing agent that are attached to the raw material.

The material that has passed through the defibrating unit 20 is referred to as a "defibrated material". In addition to the untangled defibrated material fibers, the "defibrated material" may also contain resin particles, colorants such as ink and toner, and additives such as blur preventing agents and paper strengthening agents that are separated from the fibers when the fibers are untangled. The shape of the untangled defibrated material is string-like. The untangled defibrated material may be present in a state of not being entangled with other untangled fibers, that is, in an independent state, or may be present in a state of being entangled with other untangled defibrated materials to form a clump, that is, in a state of forming a so-called "lump".

The defibrating unit 20 performs defibration by using a dry method. Here, performing a treatment of defibration or the like in air such as in the atmosphere is referred to as a dry method. For example, an impeller mill is used as the defibrating unit 20. The defibrating unit 20 has the function of causing an airflow to be generated so as to suck the raw material and discharge the defibrated material. As a result, the defibrating unit 20 can suck the raw material with the airflow from an inlet 22 and perform the defibration treatment, and transport the defibrated material to an outlet 24 by using the airflow generated by the defibrating unit 20. The defibrated material that has passed through the defibrating unit 20 is transferred to the screening unit 40 via a pipe 3. Note that the airflow for transporting the defibrated material from the defibrating unit 20 to the screening unit 40 may be the airflow generated by the defibrating unit 20 or an airflow of an airflow generating device provided as a blower or the like.

The screening unit 40 receives the defibrated material defibrated by the defibrating unit 20 from an inlet 42 and screens the defibrated material according to fiber length. The screening unit 40 includes, for example, a drum unit 41 and a housing unit 43 that houses the drum unit 41. A sieve, for example, is used as the drum unit 41. The drum unit 41 includes a mesh and can separate a first screened material from a second screened material. The first screened material is a material passing through the mesh and including fibers or particles that are smaller than the size of the openings of the mesh. The second screened material is a material not passing through the mesh and including fibers, non-defibrated pieces, or lumps that are larger than the size of the openings of the mesh. For example, the first screened material is transferred to the deposition unit 60 via a pipe 7, and the second screened material is returned to the defibrating unit 20 from an outlet 44 via a pipe 8. Specifically, the drum unit 41 is a cylindrical sieve that is driven and rotated by a motor. For example, a metal mesh, expanded metal in which a perforated metal plate is expanded, or punched metal in which holes are formed in a metal plate by a pressing machine or the like is used as the mesh of the drum unit 41.

The first web forming unit 45 transports the first screened material that has passed through the screening unit 40 to the pipe 7. The first web forming unit 45 includes, for example, a mesh belt 46, a tensioned roller 47, and a suction mechanism 48.

The suction mechanism 48 can suck the first screened material that is dispersed in air after passing through the opening of the screening unit 40 onto the mesh belt 46. The first screened material is deposited on the moving mesh belt 46 and forms a web V.

A passing-through material that has passed through the opening of the screening unit 40 is deposited on the mesh belt 46. The mesh belt 46 is tensioned by the tensioned roller 47 and is configured not to allow the passing-through material to easily pass through and to allow air to pass through the mesh belt 46. The mesh belt 46 moves by rotation of the tensioned roller 47. The web V is formed on the mesh belt 46 by the passing-through material that has passed through the screening unit 40 continuously accumulating while the mesh belt 46 continuously moves.

The suction mechanism 48 is provided below the mesh belt 46. The suction mechanism 48 can generate a downward airflow. The passing-through material dispersed in air by the screening unit 40 can be sucked onto the mesh belt 46 by the suction mechanism 48. As a result, the discharge speed from the screening unit 40 can be increased.

The web V is formed to have a large volume of air and softly swelled by passing through the screening unit 40 and the first web forming unit 45. The web V deposited on the mesh belt 46 is fed to the pipe 7 and transported to the deposition unit 60.

The rotary body 49 can cut the web V. In the example of FIG. 1, the rotary body 49 includes a base portion 49*a* and a projecting portion 49*b* projecting from the base portion 49*a*. The projecting portion 49*b* has, for example, a plate-like shape. In the example of FIG. 1, four projecting portions 49*b* are provided, and the four projecting portions 49*b* are provided at equal intervals. When the base portion 49*a* is rotated in a direction R, the projecting portions 49*b* can be rotated around the base portion 49*a*. Through cutting of the web V by the rotary body 49, for example, a fluctuation in amount of the defibrated material supplied to the deposition unit 60 per unit time can be reduced.

The mixing unit 50 mixes, for example, the first screened material that has passed through the screening unit 40 and a bonding agent. The mixing unit 50 includes, for example, a bonding agent supply unit 52 that supplies the bonding agent, a pipe 54 that transports the first screened material and the bonding agent, and a blower 56. In the example of FIG. 1, the bonding agent is supplied from the bonding agent supply unit 52 to the pipe 54 via a hopper 9. The pipe 54 is contiguous with the pipe 7.

The blower 56 generates an airflow in the mixing unit 50, and the first screened material and the bonding agent can be transported while being mixed in the pipe 54. Note that the mechanism that mixes the first screened material and the bonding agent is not particularly limited, and may be a mechanism that agitates the first screened material and the bonding agent by using blades that rotate at high speed, or may be a mechanism, such as a V-type mixer, that uses the rotation of a container.

A screw feeder, a disk feeder, or the like is used as the bonding agent supply unit 52. The bonding agent supplied from the bonding agent supply unit 52 is, for example, starch or dextrin. Starch is a polymer in which a plurality of a-glucose molecules is polymerized through glucoside bonds. Starch may exist in the form of straight chains or may branch.

Note that the bonding agent supply unit 52 may supply, in addition to the bonding agent, coloring agents for coloring the fibers, coagulation inhibitors for inhibiting aggregation of the fibers or aggregation of the bonding agent, and flame retardants for making the fibers and the like more difficult to burn, according to the type of a fiber body S to be manufactured. A mixture that has passed through the mixing unit 50 is transferred to the deposition unit 60 via the pipe 54.

The deposition unit 60 receives, from an inlet 62, the mixture that has passed through the mixing unit 50, unravels the entangled defibrated material, and causes the defibrated material to descend while dispersing the defibrated material in air. As a result, the deposition unit 60 can uniformly deposit the mixture on the second web forming unit 70.

The deposition unit 60 includes, for example, a drum unit 61 and a housing unit 63 that houses the drum unit 61. A cylindrical sieve that rotates is used as the drum unit 61. The drum unit 61 includes a mesh and causes fibers or particles included in the mixture that has passed through the mixing unit 50 and smaller than the size of the openings of the mesh to descend. The configuration of the drum unit 61 is, for example, the same as the configuration of the drum unit 41.

Note that the "sieve" of the drum unit 61 does not have to have a function of screening specified target materials. That is, the term "sieve" used as the drum unit 61 means a sieve provided with a mesh, and the drum unit 61 may cause all of the mixture introduced into the drum unit 61 to descend.

The second web forming unit 70 accumulates the passing-through material that has passed through the deposition unit 60 and forms a web W. The second web forming unit 70 includes, for example, a first mesh belt 72 as a first transport belt, a tensioned roller 74, and a suction mechanism 76.

The passing-through material that has passed through the openings of the deposition unit 60 is deposited on the first mesh belt 72. The first mesh belt 72 is tensioned by the tensioned roller 74 and is configured not to allow the passing-through material to easily pass through and to allow air to pass through the first mesh belt 72. The first mesh belt 72 moves by rotation of the tensioned roller 74. The web W is formed on the first mesh belt 72 by the passing-through material that has passed through the deposition unit 60 continuously accumulating while the first mesh belt 72 continuously moves.

The suction mechanism 76 is provided below the first mesh belt 72. The suction mechanism 76 can generate a downward airflow. The mixture dispersed in air by the deposition unit 60 can be sucked onto the first mesh belt 72 by the suction mechanism 76. As a result, the discharge speed from the deposition unit 60 can be increased. Moreover, a down flow can be formed by the suction mechanism 76 in a dropping path of the mixture, and the defibrated material and the bonding agent can be prevented from being entangled while the mixture is dropping.

As described above, the web W is formed to have a large volume of air and softly swelled by passing through the deposition unit 60 and the second web forming unit 70.

The transport unit 78 is disposed downstream on the first mesh belt 72 in the transport direction of the web W. The transport unit 78 separates the web W on the first mesh belt 72 from the first mesh belt 72 and transports the web W toward the pressing unit 80. The transport unit 78 includes a second mesh belt 78*a* as a second transport belt, a roller 78*b*, and a suction mechanism 78*c*. The second mesh belt 78*a* is tensioned by the roller 78*b* and is configured to allow air to pass through the second mesh belt 78*a*. The second mesh belt 78*a* is configured to move by rotation of the roller 78*b*. The suction mechanism 78*c* is disposed at a position facing the web W with the second mesh belt 78*a* interposed therebetween. The suction mechanism 78*c* includes a blower and generates an upward airflow on the second mesh belt 78*a* by the suction power of the blower. The web W is sucked by the airflow.

As a result, one surface of the web W is separated from the first mesh belt 72, and another surface, which is an opposite surface from the surface that is separated from the first mesh belt 72, can be sucked onto the second mesh belt 78*a*. The web W sucked onto the second mesh belt 78*a* is transported in a state of being in contact with the second mesh belt 78*a*.

The moisture applying unit 79 is disposed below the transport unit 78. The moisture applying unit 79 applies moisture toward a first surface of the web W in contact with the second mesh belt 78*a*. The moisture applying unit 79 applies, for example, water vapor or mist as moisture to the web W. As a result, moisture can be uniformly applied to the web W.

The pressing unit 80 is disposed downstream of the transport unit 78 and the moisture applying unit 79. The web W to which moisture is applied is transported to the pressing unit 80.

The pressing unit 80 presses the web W to which moisture is applied and that is separated from the second mesh belt 78*a*. The pressing unit 80 of the present embodiment simultaneously performs pressing and heating on the web W to which moisture is applied. As a result, the moisture contained in the web W evaporates after the temperature rises, and at the same time, the web W becomes thinner and the fiber density is increased. When the temperatures of the moisture and the bonding agent rise by heat and the fiber density is increased by pressure, the bonding agent is gelatinized. Thereafter, a plurality of fibers is bonded via the bonding agent that is gelatinized by the moisture evaporation. Moreover, when the moisture evaporates by heat and the fiber density is increased by pressure, a plurality of fibers is bonded by hydrogen bonds. As a result, the sheet-like fiber body S having higher mechanical strength can be formed.

The pressing unit 80 of the present embodiment includes a pressing and heating unit 84 that presses and heats the web W. The pressing and heating unit 84 is configured using, for example, a heating roller and a heat press-molding machine. In the example of FIG. 1, the pressing and heating unit 84 is a pair of rollers 86*a* and 86*b*. Note that the number of the rollers 86*a* and 86*b* is not particularly limited. Pressing and heating can be simultaneously performed on the web W by the pressing and heating unit 84.

A separating unit 100 that separates the web W, that is, the sheet-like fiber body S adhering to the roller 86*b* from the roller 86*b* is disposed near the roller 86*b* of the pair of rollers 86*a* and 86*b*.

The cutting unit 90 cuts the fiber body S formed by the pressing unit 80. In the example of FIG. 1, the cutting unit 90 includes a first cutting unit 92 that cuts the fiber body S in a direction intersecting the transport direction of the fiber body S, and a second cutting unit 94 that cuts the fiber body S in a direction parallel to the transport direction. For example, the second cutting unit 94 cuts the fiber body S that has passed through the first cutting unit 92. As described above, a single sheet of the cut fiber body S of a predetermined size is formed. The single sheet of the cut fiber body S is discharged to a discharge receiving unit 96. Hereinafter, the web W and the fiber body S are referred to as a sheet S.

Next, with reference to FIGS. 2 to 5, a configuration of a sheet separating apparatus 100A will be described.

As illustrated in FIGS. 2 to 5, the sheet separating apparatus 100A includes the pair of rollers 86*a* and 86*b* that transports the sheet S while heating the sheet S, and the separating unit 100 that is disposed near the roller 86*b*, which is one roller of the pair of rollers 86*a* and 86*b*. Hereinafter, the roller 86*a* is referred to as a first roller 86*a*, and the roller 86*b* is referred to as a second roller 86*b* as the one roller.

The separating unit 100 includes a separating plate 200 having a leading end portion 201 that comes into contact with the second roller 86*b*, and a supporting portion 300 that supports the separating plate 200. When the leading end portion 201 of the separating plate 200 comes into contact with a surface of the second roller 86*b*, a leading end of the sheet S transported, that is, a leading end of the sheet S adhering to the second roller 86*b* can be separated from the second roller 86*b*.

Three press rollers 410, 420, and 430 are in contact with the surface of the second roller 86*b*. As a result, the transported sheet S can be transported in a direction toward the separating unit 100. In addition, a wind-around roller 450 for transporting the sheet S downstream is disposed near the separating unit 100. That is, the sheet S that has passed between the rollers 86*a* and 86*b* passes between the separating unit 100 and the wind-around roller 450 and is transported downstream.

Figure 3:
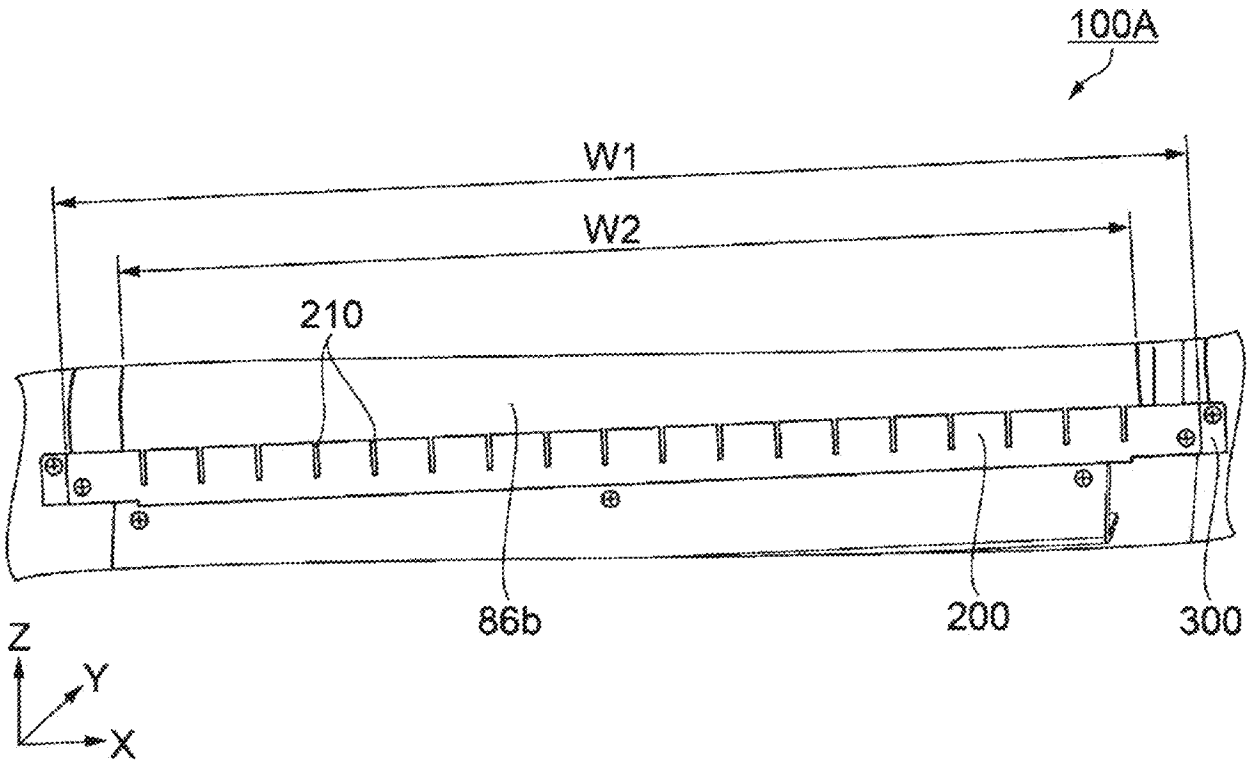
FIG. 3 is a perspective view illustrating the configuration of the sheet separating apparatus.

As illustrated in FIG. 3, a width W1 of the separating plate 200 is greater than a width W2 of the second roller 86*b*. Therefore, the entire width of the sheet S adhering to the second roller 86*b* can be reliably separated by the separating plate 200. In addition, the separating plate 200 is provided with slits 210 at predetermined intervals.

Figure 4:
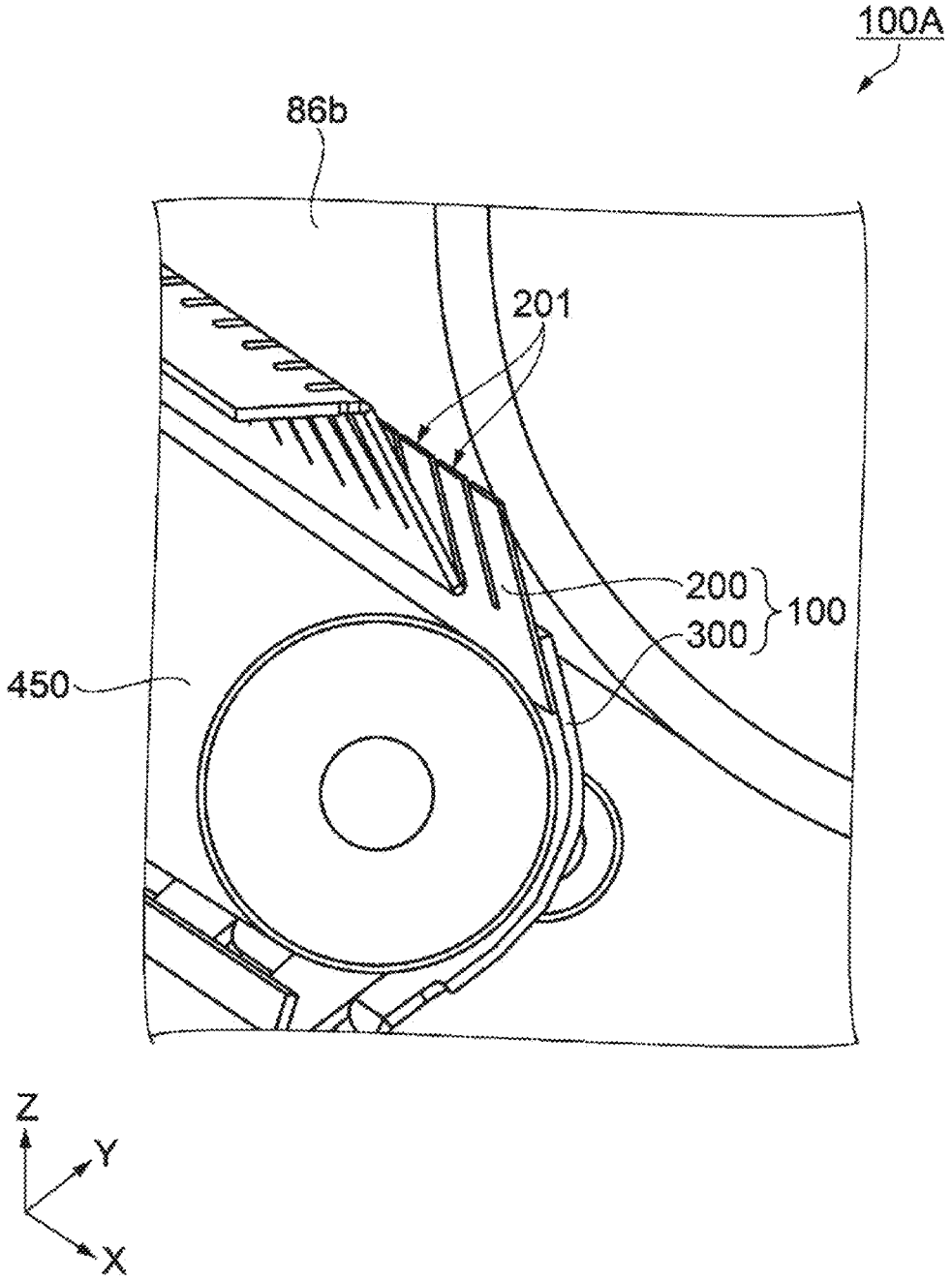
FIG. 4 is an enlarged perspective view illustrating a portion IV of the sheet separating apparatus illustrated in FIG. 2.
Figure 5:
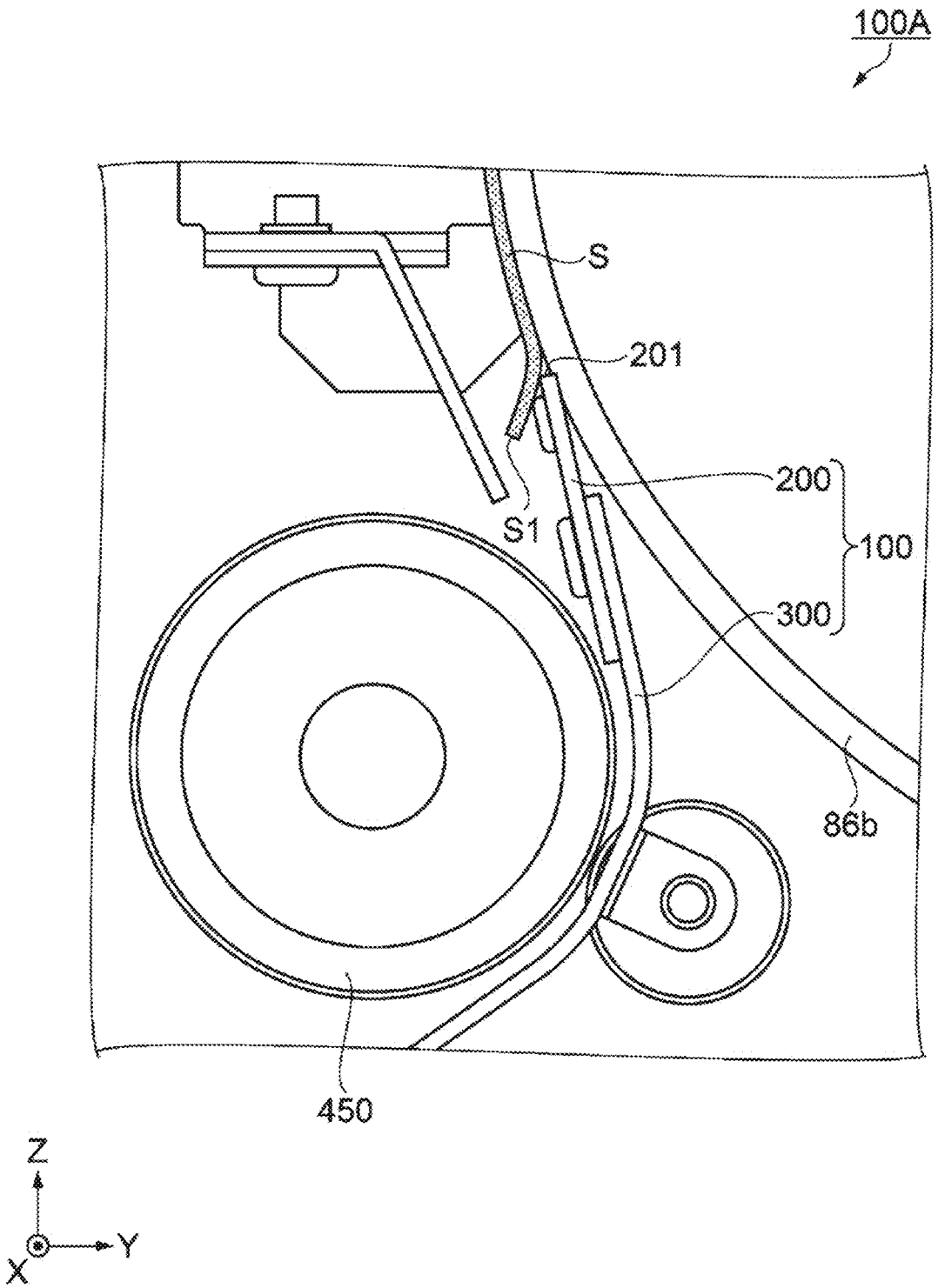
FIG. 5 is an enlarged side view illustrating a portion V of the sheet separating apparatus illustrated in FIG. 2.

As illustrated in FIGS. 4 and 5, the separating unit 100 is disposed such that the leading end portion 201 of the separating plate 200 comes into contact with the surface of the second roller 86*b*. As a result, when a leading end portion S1 of the sheet S adhering to the second roller 86*b* comes into contact with the leading end portion 201 of the separating plate 200, the leading end portion S1 of the sheet S can be separated, and the sheet S can be transported downstream.

Next, with reference to FIGS. 6 to 8, configurations of the separating unit 100 and the separating plate 200 will be described.

Figure 6:
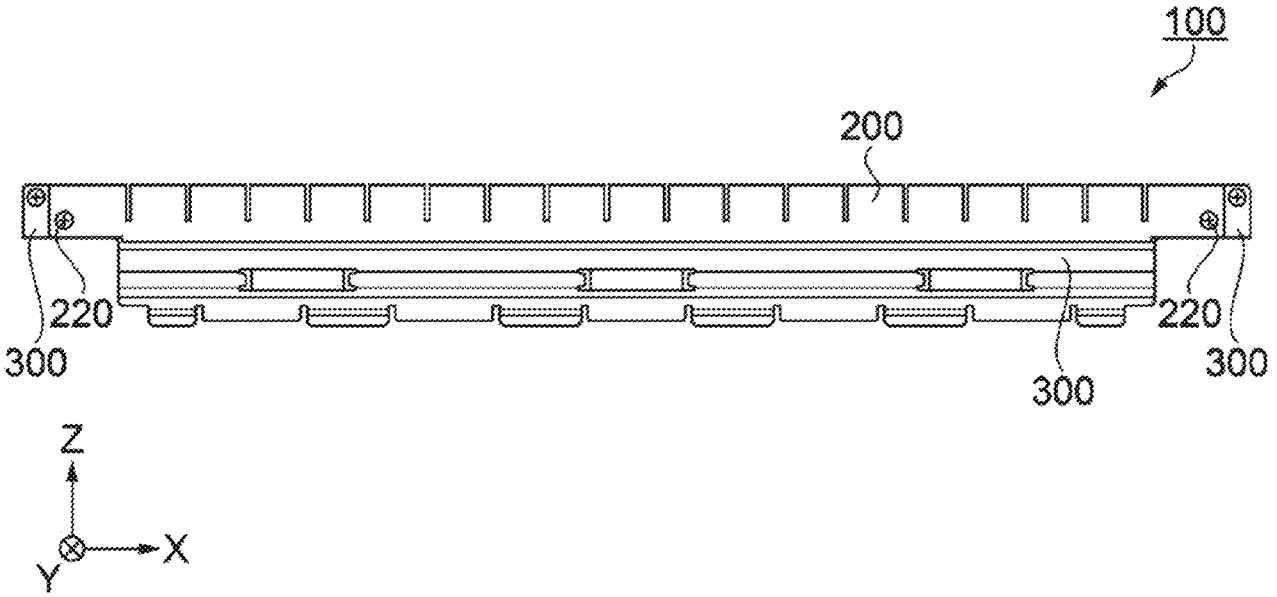
FIG. 6 is a plan view illustrating a configuration of a separating unit.

As illustrated in FIG. 6, the separating unit 100 includes the separating plate 200 and the supporting portion 300 that supports the separating plate 200 as described above. The separating plate 200 is fixed to the supporting portion 300 by using fixing screws 220 disposed on one end portion side and another end portion side in the X direction. In addition, the separating plate 200 is fixed to the supporting portion 300 by using double-sided tape.

Figure 7:
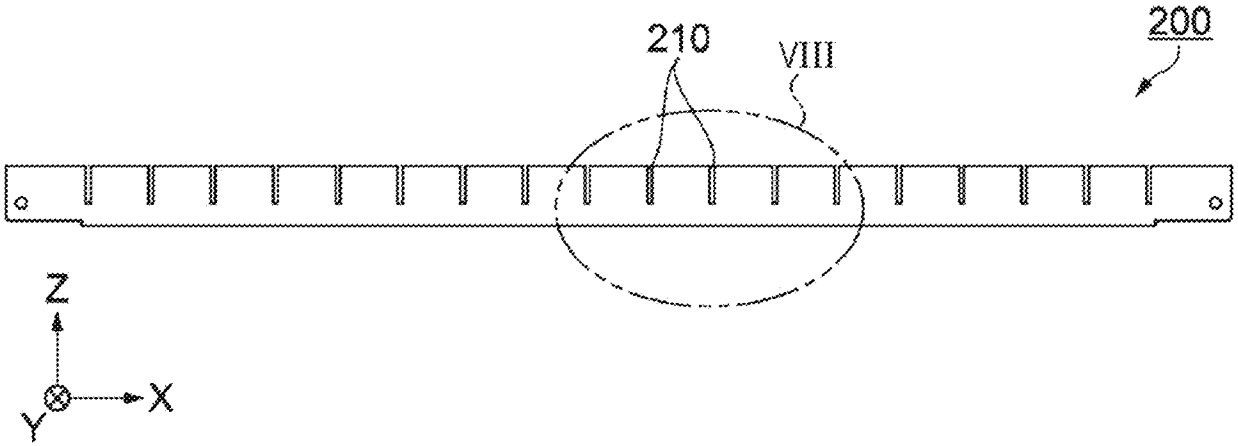
FIG. 7 is a plan view illustrating a configuration of a separating plate.
Figure 8:
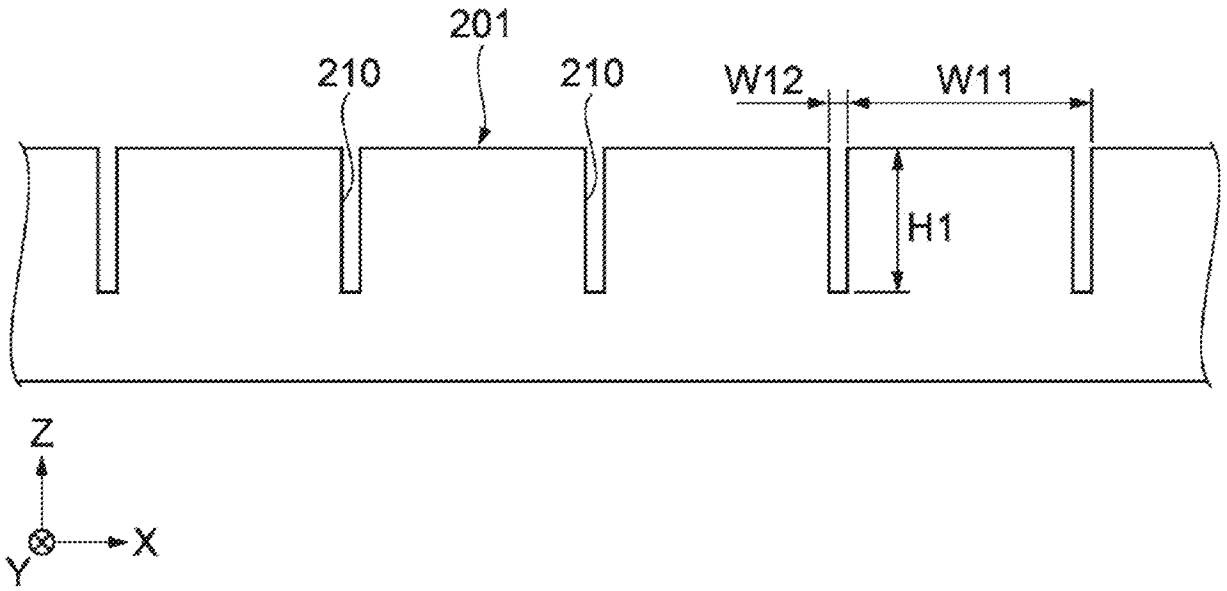
FIG. 8 is an enlarged plan view illustrating a portion VIII of the separating plate illustrated in FIG. 7.

As illustrated in FIGS. 7 and 8, the separating plate 200 is provided with a plurality of slits 210 at predetermined intervals. An interval W11 between the slits 210 is, for example, 20 mm. A width W12 of each slit 210 is, for example, 2 mm. A height H1 of each slit 210 is, for example, 10 mm. A thickness of the separating plate 200 is, for example, 0.3 mm.

The material of the separating plate 200 is preferably flexible and heat-resistant, and is, for example, polyimide. Since the separating plate 200 is made of polyimide, the separating plate 200 is highly heat-resistant, and in addition, is less likely to damage the second roller 86*b* when coming into contact with the second roller 86*b*.

Examples of the material of the supporting portion 300 include steel electrolytic cold commercial (SECC) or stainless steel. As described above, the supporting portion 300 and the separating plate 200 have different thermal expansion coefficients. Specifically, the supporting portion 300 is less likely to expand with heat, and the separating plate 200 easily shrinks.

However, since the plurality of slits 210 is formed in the separating plate 200, bending of the separating plate 200 due to the thermal expansion difference between the separating plate 200 and the supporting portion 300 can be absorbed. That is, compared to a case where the separating plate 200 is provided with no slit 210, the separating plate 200 provided with the slits 210 can mitigate expansion and contraction.

As described above, even when heat is transmitted to the separating plate 200 and the supporting portion 300, since the separating plate 200 is provided with the slits 210, bending due to the thermal expansion difference between the separating plate 200 and the supporting portion 300 can be absorbed by the slits 210. Therefore, bending of the leading end portion 201, in the separating plate 200, that comes into contact with the sheet S, in other words, occurrence of warping can be suppressed. As a result, the leading end portion 201 of the separating plate 200 can come into contact with the second roller 86*b* without a gap, and the sheet S adhering to the second roller 86*b* can be separated from the second roller 86*b*. As a result, the sheet S can be reliably transported downstream.

Next, with reference to FIGS. 9 to 11, operation of the separating unit 100 will be described.

Figure 9:
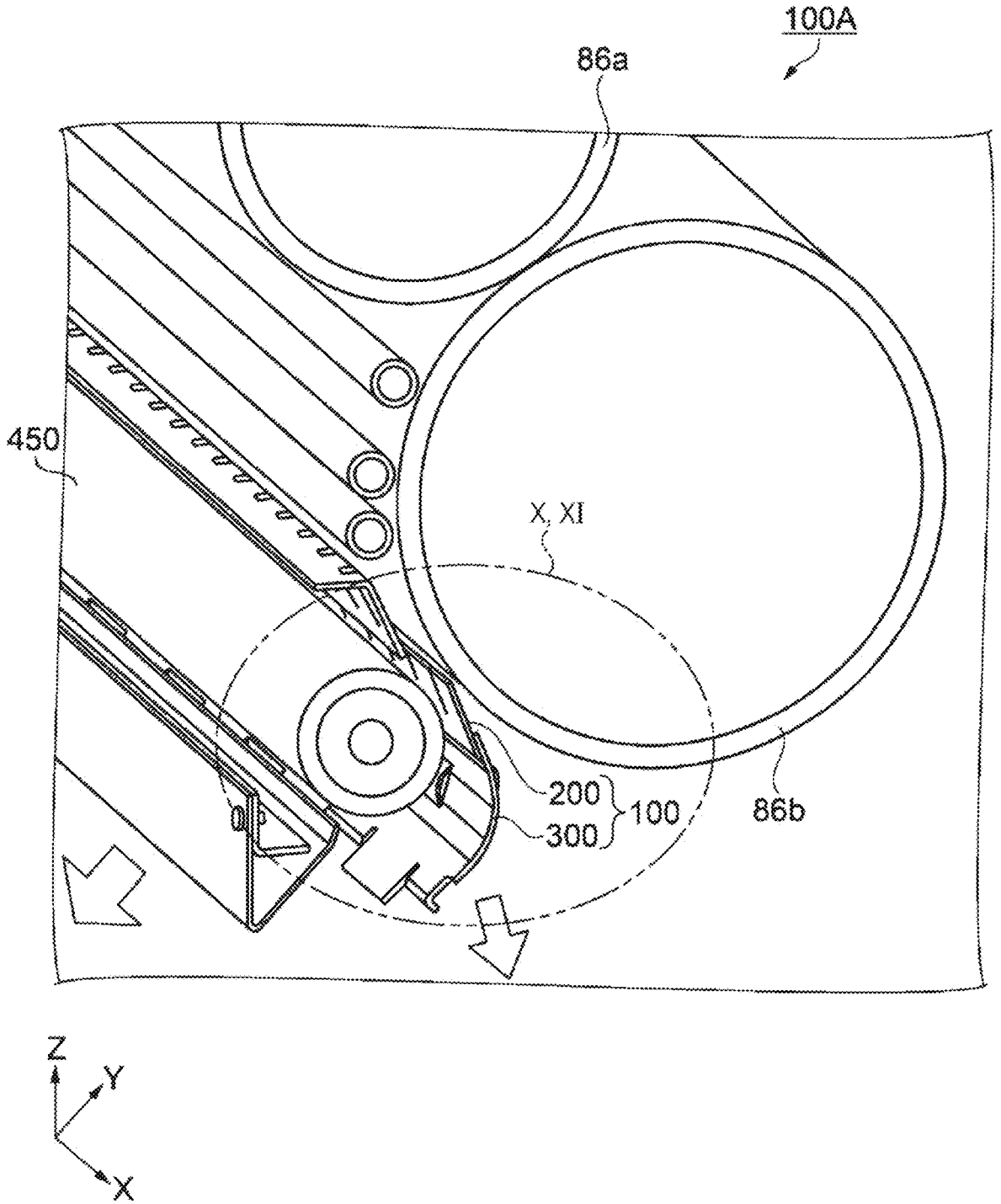
FIG. 9 is a perspective view illustrating a configuration of the sheet separating apparatus in a state in which the separating unit is retreated.
Figure 10:
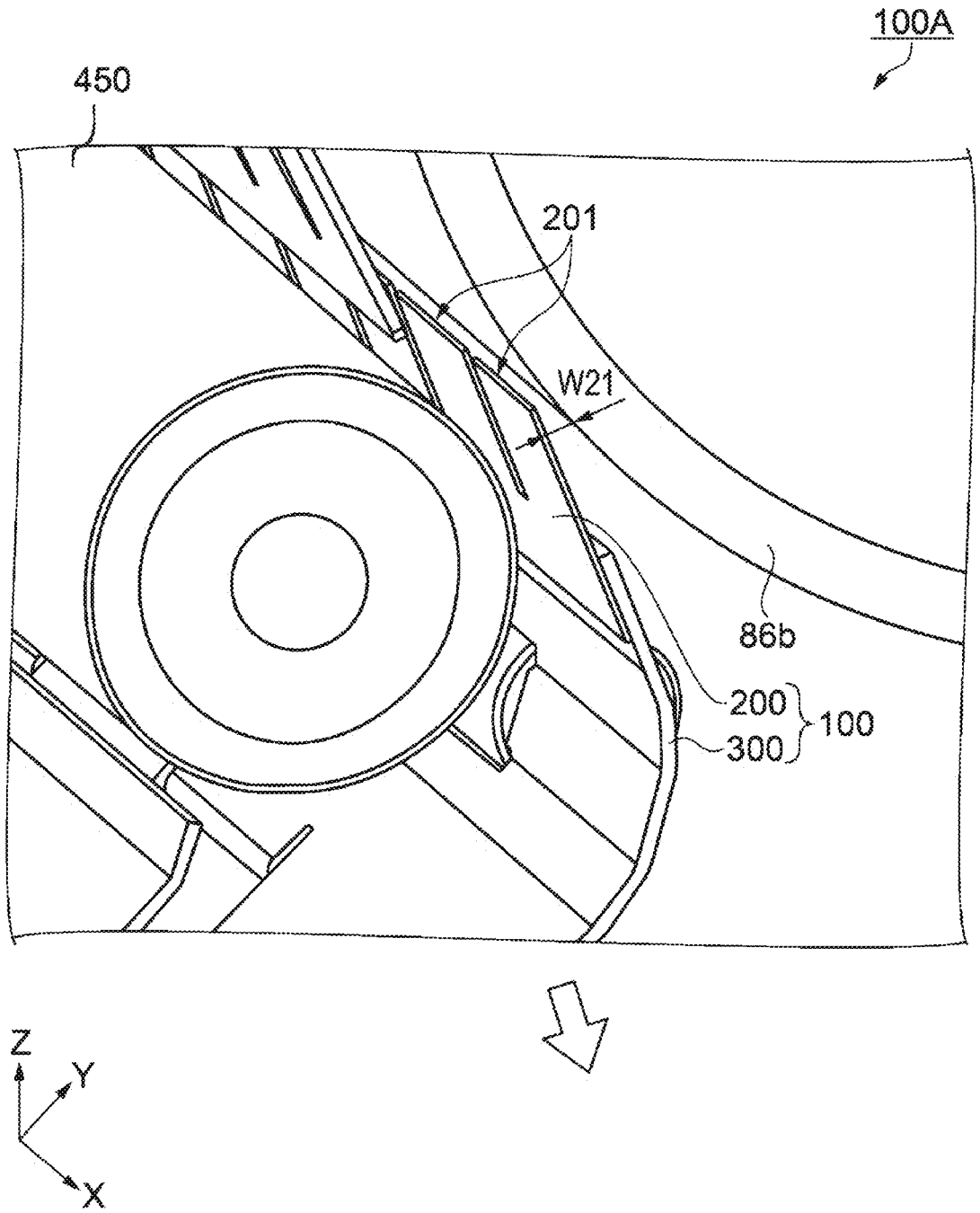
FIG. 10 is an enlarged perspective view illustrating a portion X of the sheet separating apparatus illustrated in FIG. 9.
Figure 11:
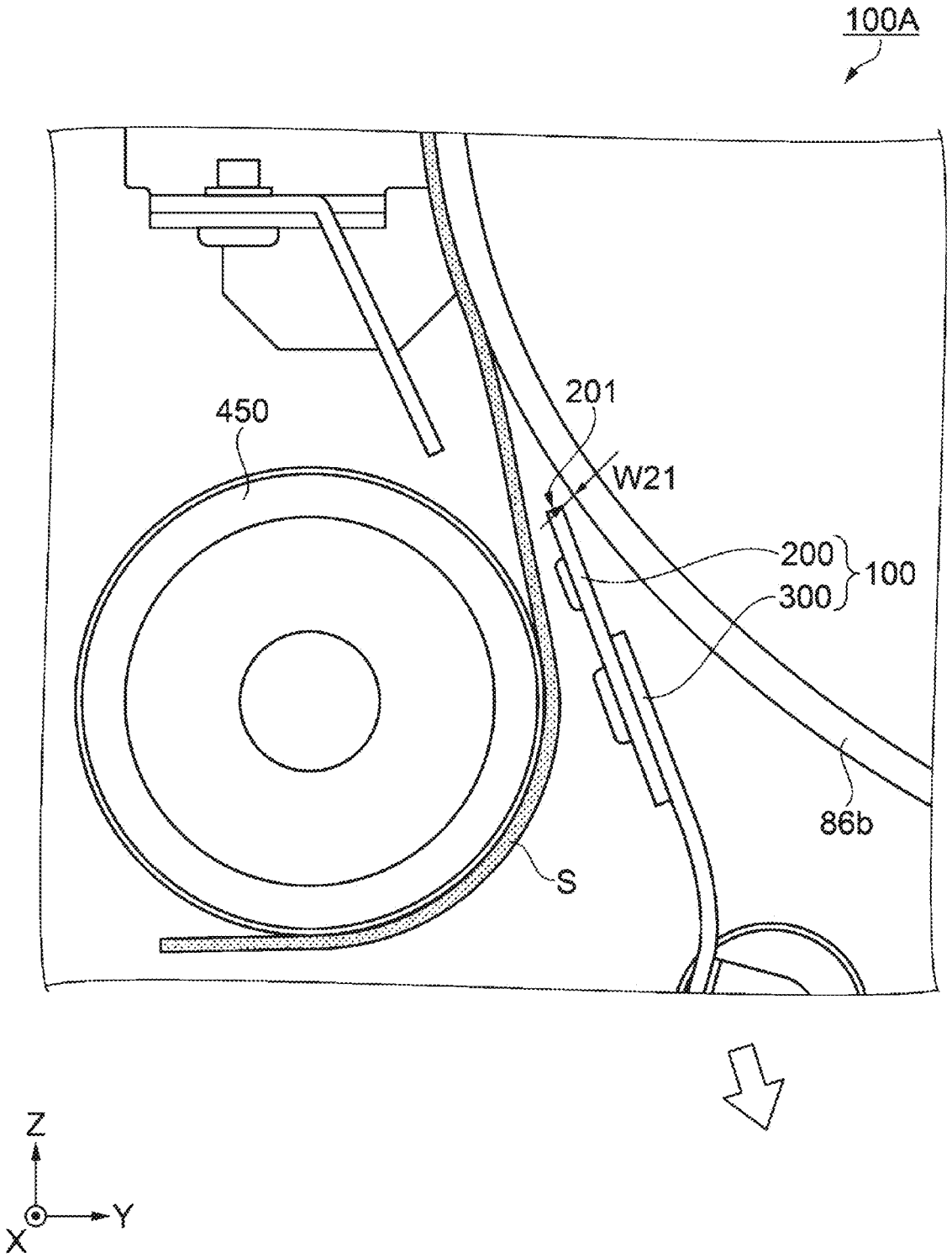
FIG. 11 is an enlarged side view illustrating a portion XI of the sheet separating apparatus illustrated in FIG. 9.

As illustrated in FIGS. 9 to 11, the separating unit 100 is disposed so as to be able to move in a direction away from the second roller 86*b* and the wind-around roller 450 (arrow directions illustrated in FIGS. 10 and 11). In other words, the separating unit 100, that is, the leading end portion 201 of the separating plate 200 is disposed so as to be able to come into contact with or be separated from the second roller 86*b*. That is, the leading end portion 201 of the separating plate 200 can be selectively in contact with or in non-contact with the surface of the second roller 86*b*. When the separating unit 100 is moved, a gap W21 can be made between the leading end of the separating plate 200 and the second roller 86*b* (see FIGS. 10 and 11).

As described above, since the separating unit 100 is disposed so as to be able to come into contact with or be separated from the second roller 86*b*, when the sheet S adhering to the second roller 86*b* is separated, the separating unit 100 comes into contact with the surface of the second roller 86*b*, and after the sheet S is separated, the separating unit 100 is caused to be in non-contact, that is, the separating unit 100 is separated from the second roller 86*b*. As a result, damage to the surface of the second roller 86*b* and deterioration of the surface can be suppressed.

As described above, the sheet separating apparatus 100A of the present embodiment includes the rollers 86*a* and 86*b* that transport the sheet S while heating the sheet S, and the separating unit 100 that includes the separating plate 200 having the leading end portion 201 that comes into contact with the second roller 86*b* of the rollers 86*a* and 86*b*, and the supporting portion 300 that supports the separating plate 200. The separating plate 200 is provided with the slits 210 that absorb bending due to a thermal expansion difference between the separating plate 200 and the supporting portion 300.

According to this configuration, even when the sheet S is heated and the heat is transmitted to the separating plate 200 and the supporting portion 300, since the separating plate 200 is provided with the slits 210, bending due to the thermal expansion difference between the separating plate 200 and the supporting portion 300 can be absorbed by the slits 210. Therefore, bending of the leading end portion 201, in the separating plate 200, that comes into contact with the sheet S, in other words, occurrence of warping can be suppressed. As a result, the leading end portion 201 of the separating plate 200 can come into contact with the second roller 86*b* without a gap, and the sheet S adhering to the second roller 86*b* can be separated from the second roller 86*b*. As a result, the sheet S can be reliably transported downstream.

In addition, in the sheet separating apparatus 100A of the present embodiment, it is preferable that the separating unit 100 is disposed so as to be able to come into contact with or be separated from the second roller 86*b*, and the separating unit 100 can be selectively in contact with or in non-contact with the surface of the second roller 86*b*. According to this configuration, since the separating unit 100 is disposed so as to be able to come into contact with or be separated from the second roller 86*b*, when the sheet S adhering to the second roller 86*b* is separated, the separating unit 100 comes into contact with the surface of the second roller 86*b*, and after the sheet S is separated, the separating unit 100 is in non-contact, that is, the separating unit 100 is separated from the second roller 86*b*. As a result, damage to the second roller 86*b* can be suppressed.

In addition, in the sheet separating apparatus 100A of the present embodiment, the separating plate 200 is preferably made of polyimide. According to this configuration, since the separating plate 200 is made of polyimide, the separating plate 200 is highly heat-resistant, and in addition, is less likely to damage the second roller 86*b* when coming into contact with the second roller 86*b*.

In addition, the sheet manufacturing apparatus 1000 of the present embodiment includes the supply unit 10 that supplies a raw material, the deposition unit 60 that accumulates a part of the raw material and forms the sheet S, the pressing unit 80 that presses the sheet S, and the cutting unit 90 that cuts the sheet S. The pressing unit 80 includes the rollers 86*a* and 86*b* that transport the sheet S while heating the sheet S, and the separating unit 100 that includes the separating plate 200 having the leading end portion 201 that comes into contact with the second roller 86*b* of the rollers 86*a* and 86*b*, and the supporting portion 300 that supports the separating plate 200. The separating plate 200 is provided with the slits 210 that absorb bending due to a thermal expansion difference between the separating plate 200 and the supporting portion 300.

According to this configuration, even when the sheet S is heated and the heat is transmitted to the separating plate 200 and the supporting portion 300, since the separating plate 200 is provided with the slits 210, bending due to the thermal expansion difference between the separating plate 200 and the supporting portion 300 can be absorbed by the slits 210. Therefore, bending of the leading end portion 201, in the separating plate 200, that comes into contact with the sheet S, in other words, occurrence of warping can be suppressed. As a result, the leading end portion 201 of the separating plate 200 can come into contact with the second roller 86*b* without a gap, and the sheet S adhering to the second roller 86*b* can be separated from the second roller 86*b*. As a result, the sheet S can be reliably transported downstream.

Hereinafter, a modification of the above-described embodiment will be described.

Figure 12:
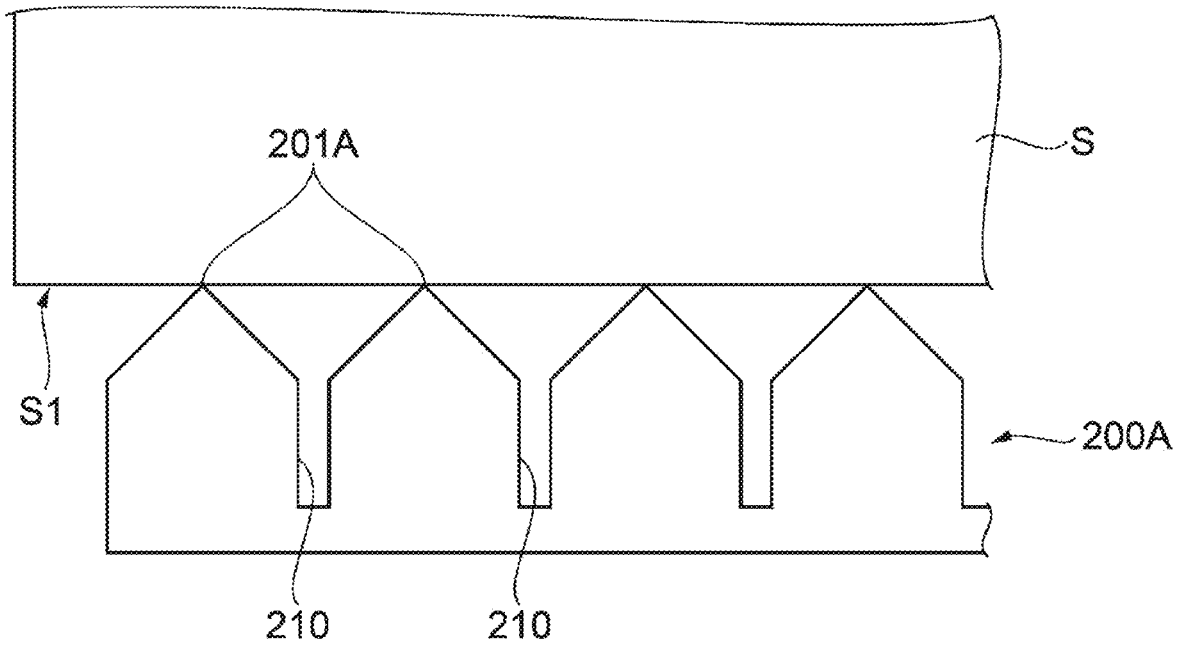
FIG. 12 is a plan view illustrating a configuration of a separating plate in a modification.

The contact between the separating plate 200 and the leading end portion S1 of the sheet S is not limited to a surface contact, as described in the above-described embodiment, and the contact may be made as illustrated in FIG. 12. In a separating plate 200A of the modification, the shape of a leading end portion 201A is formed into a projection. That is, instead of a surface contact, a point contact is made with respect to the sheet S.

As described above, it is possible to reduce the resistance when the separating plate 200A is in contact with the sheet S, and even when there is a gap to some extent between the sheet S and the second roller 86*b*, jamming of the sheet S can be prevented.

What is claimed is:

1. A sheet separating apparatus comprising:

a pair of rollers that transports a sheet while heating the sheet; and a separating unit including a separating plate and a supporting portion, the a separating plate having a leading end portion that comes into contact with one roller of the pair of rollers, the supporting portion supporting the separating plate, the separating plate having a slit that absorbs bending due to a thermal expansion difference between the separating plate and the supporting portion, the separating plate being made of polyimide, and further comprising a wind-around roller facing the separating plate and the supporting portion, wherein the wind-around roller is arranged such that the sheet that has passed between the pair of rollers passes between the separating unit and the wind-around roller and between the supporting portion and the wind-around roller, and is transported downstream.

2. The sheet separating apparatus according to claim 1, wherein the separating unit is disposed and configured to come into contact with or be separated from the one roller, and is configured to be selectively in contact with or in non-contact with the one roller.

3. A sheet manufacturing apparatus comprising:

a supply unit that supplies a raw material;

a deposition unit that accumulates a part of the raw material and forms a sheet;

a pressing unit that presses the sheet; and a cutting unit that cuts the sheet, the pressing unit including a pair of rollers that transports the sheet while heating the sheet, and a separating unit including a separating plate and a supporting portion, the separating plate having a leading end portion that comes into contact with one roller of the pair of rollers, the supporting portion supporting the separating plate, and the separating plate having a slit that absorbs bending due to a thermal expansion difference between the separating plate and the supporting portion, and the separating plate being made of polyimide, and further comprising a wind-around roller facing the separating plate and the supporting portion, wherein the wind-around roller is arranged such that the sheet that has passed between the pair of rollers passes between the separating unit and the wind-around roller and between the supporting portion and the wind-around roller, and is transported downstream.

4. The sheet separating apparatus according to claim 1, wherein the supporting portion is made of steel electrolytic cold commercial or stainless steel.

* * * * *